United States Patent [19]

Kikuchi et al.

[11] 4,095,406

[45] Jun. 20, 1978

[54] SECOND ADJUSTMENT SYSTEM IN AN ELECTRONIC WATCH

[75] Inventors: Tadahiro Kikuchi, Tokyo; Yukio Ikehata, Matsudo; Masataka Ikenishi, Soka; Shozo Kushida, Narashino, all of Japan

[73] Assignee: Kabushiki Kaisha Daini Seikosha, Japan

[21] Appl. No.: 609,065

[22] Filed: Aug. 29, 1975

[30] Foreign Application Priority Data

Sep. 6, 1974 Japan ..... 49-102613

[51] Int. Cl.[2] ..... G04B 27/00; G04C 3/00

[52] U.S. Cl. ..... 58/23 R; 58/50 R; 58/85.5

[58] Field of Search ..... 58/4 A, 23 R, 23 A, 58/38 R, 39.5, 50 R, 58, 85.5

[56] References Cited

U.S. PATENT DOCUMENTS

| | | | |
|---|---|---|---|
| 3,576,099 | 4/1971 | Walton | 58/23 R |
| 3,733,803 | 5/1973 | Hiraga et al. | 58/23 R |
| 3,762,152 | 10/1973 | Marz | 58/50 R |
| 3,789,600 | 2/1974 | Champan | 58/39.5 |
| 3,792,577 | 2/1974 | Fujita | 58/34 |
| 3,810,354 | 5/1974 | Naikaido | 58/34 |
| 3,841,081 | 10/1974 | Komaki | 58/23 R |
| 3,854,277 | 12/1974 | Samejima | 58/39.5 |
| 3,975,896 | 8/1976 | Kasama | 58/23 R |

*Primary Examiner*—E. S. Jackmon

*Attorney, Agent, or Firm*—Robert E. Burns; Emmanuel J. Lobato; Bruce L. Adams

[57] ABSTRACT

Second adjustment system in an electronic watch employing a quartz oscillator as a time base. The watch comprises a standard oscillating circuit including the quartz oscillator, a divider, a driving circuit, and a converter. The divider produces several oscillatory output signals of different frequency so as to produce diverse time signals. A time signal selection switch selects output among these outputs. The selected output time signal corresponds to the signal required for adjusting a time delay or a time advance of the seconds indicated by the watch. An incorrect time is corrected during normal watch operation by this second adjustment system.

5 Claims, 5 Drawing Figures

SECOND ADJUSTMENT SYSTEM IN AN ELECTRONIC WATCH

BACKGROUND OF THE INVENTION

This invention relates to an electronic watch, and more particularly to a second indication adjusting system in the electronic watch employing a quartz oscillator or a tuning fork type oscillator as a time base.

Conventionally, in such electronic watches, there is not provided a second indication adjusting function. After stopping the operation of a watch, the second indication is adjusted by setting again a second hand to a correct time. Therefore, it is impossible to avoid the inconvenience caused by the adjustment. In particular, the adjustment for a time lag of a second in the second indication is inconvenient, since it is required that the watch operation be stopped during several minutes for more than a minute in spite of only a second delay of the second indication.

SUMMARY OF THE INVENTION

It is therefore an object of this invention to provide an electronic watch provided with a second adjustment system capable of briefly adjusting incorrect times of only a second delay or advance in a second indication without stopping the operation of the watch.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

The present invention will be fully described by way of the embodiment in connection with the accompanying drawings.

Figure 1:
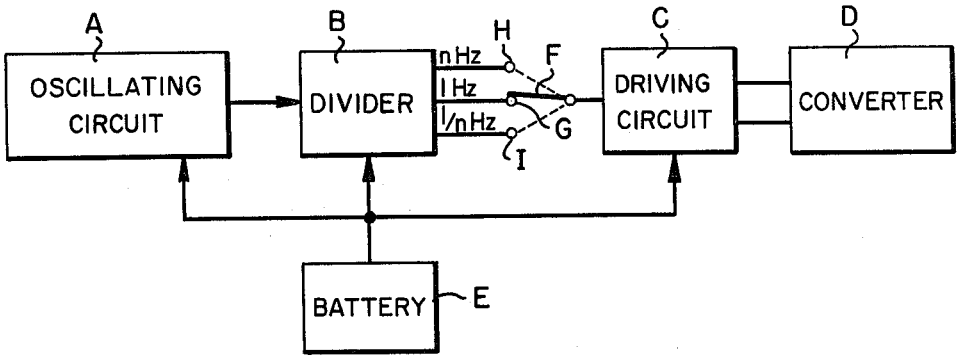
FIG. 1 is a circuit block diagram illustrating a second adjustment system of the present invention.

FIG. 1 shows a block representation diagram showing a circuit block of a second adjustment system of the present invention. A standard oscillating circuit A, in which a quartz oscillator is used as a time base, changes the oscillation thereof having a relatively high frequency to a signal which is applied to a divider B. The signal applied to the divider is counted down therein, so that time signals of various output pulses: 1 Hz, $n$ Hz and $1/n$ Hz ($n$:integer) are produced. For instance, it is assumed that the time signal as mentioned above may be produced in several different combinations such as the following (1) 1 Hz, 2 Hz, ½ Hz (2) 1 Hz, 2 Hz, 5 Hz, 1/2 Hz, 1/5 Hz (3) 1 Hz, 2 Hz, 5 Hz, 10 Hz, 1/2 Hz, 1/5 Hz, 1/10 Hz The time signal as mentioned above is converted into a time indication by being applied through a driving circuit C to a converter D. The circuit is powered by the battery E. In normal operation of the watch, a second adjustment switch F is connected to a terminal G for a 1 Hz time signal, so that a second signal is fed to the driving circuit C and the converter D to indicate normal time. Terminal H for a time signal $n$ Hz is provided to advance a second hand while a terminal I for a time signal $1/n$ Hz is provided to delay the second hand.

When adjusting the delay of the second hand, the second adjustment or time signal selection switch F is connected to the terminal H. At this time, provided $n$ Hz is 2 Hz, the time signal of 2 Hz is supplied to the driving circuit C and the converter D so that the speed of the second hand increases to two times the usual speed. While, in order to adjust the advance of the second hand, the connection terminal of the second adjustment switch F is changed to the terminal I. At this time, provided $1/n$ Hz is ½ Hz, the time signal of ½ Hz is supplied to the driving circuit C and the converter D, whereby the speed of the second hand is reduced to a half of the usual speed.

In this way, after the second hand is advanced by "$n$" times or "$1/n$" times the usual speed to set the indicated time to a standard time, the connection terminal of the second adjustment switch F is changed again to the terminal G for the normal time signal. The watch operation again becomes normal where the second hand is driven once per second, so that the second indication of the watch is indicated once per second.

Figure 2:
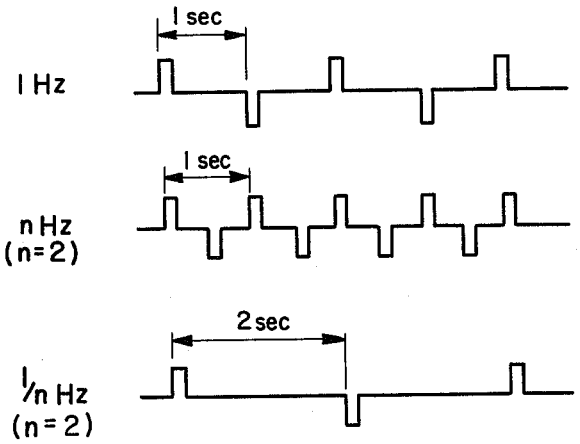
FIG. 2 shows waveforms of output pulses corresponding to time signals produced by a divider.

FIG. 2 shows waveforms of outputs corresponding to time signals used in the electronic watch according to the present invention.

Figure 3:
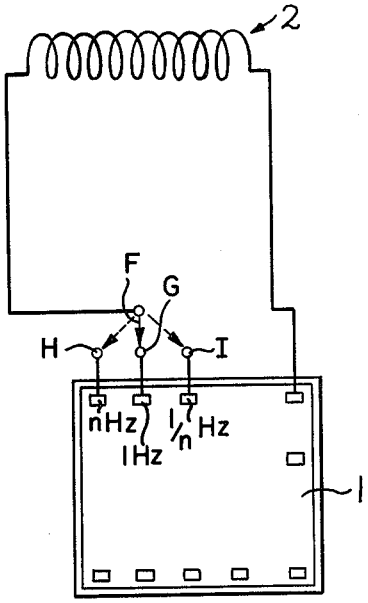
FIG. 3 is a connection diagram showing an example of circuit construction of terminals for time signals.

FIG. 3 is a connection diagram showing an example of a circuit construction for time signal terminals in the present invention. A coil 2 is connected to I.C. chip 1 by means of a plurality of terminals. Though 1 Hz output pulse is supplied to the coil 2 in the normal operation of the electronic watch, either one output pulse of $n$ Hz or $1/n$ Hz is supplied to the coil 2 in accordance with the change of the second adjustment switch to adjust the second indication.

Figure 4:
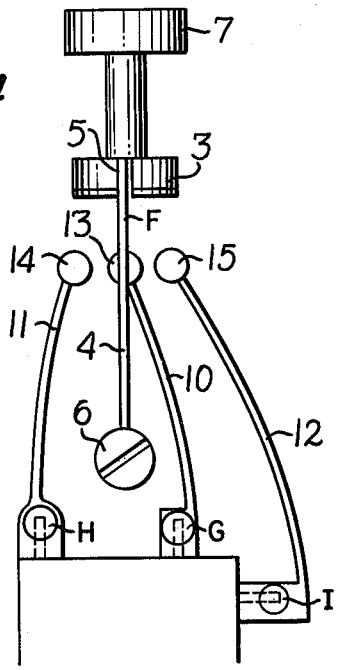
FIG. 4 is a plane view showing a detailed construction of a second adjustment switch and terminals in the present invention.

FIG. 4 is a plane view showing the detailed construction of the second adjustment switch and terminals employed in the present invention.

Figure 5:
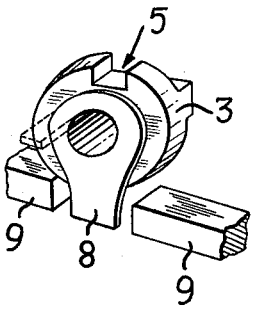
FIG. 5 is a perspective view of the second adjustment switch shown in FIG. 4.

FIG. 5 is a perspective view of the second adjustment switch shown in FIG. 5.

In FIG. 4, the second adjustment switch F comprises a rotary means 3 and a lead means 4. The rotary means 3 is in a circular form having a certain thickness and is provided with a groove 5 at its upper surface. One end of the lead means 4 is inserted into the groove 5 of the rotary means 3 while the other end thereof is connected to a terminal 6 of a driving circuit C. The rotary means 3 is mounted to a switch setting knob or button 7 in such a way that both the rotary and lead means are rotatable as one body when the switch setting knob is rotated. The rotary means is further provided with a stopper 8 for preventing its excessive rotation. The rotation is limited by means of the stopper 8 which is received by a stopper receiver 9. Terminals for time signals comprises lead members 10, 11 and 12 and contact means 13, 14 and 15 which are provided at end portions of said lead members.

The lead means 4 is connected to the contact means 13 of the terminal G for the 1 Hz time signal in the normal operation of the watch. When the switch setting knob 7 is rotated into a left direction in FIG. 4 in order to adjust the second indication, the rotary means 3 rotated in the left direction together with the switch setting knob 7 so that the lead means 4 moves in the same direction. The lead means 4 is disconnected from the contact means 13 and in turn touches the contact means 14 to be connected to the terminal H for the $n$ Hz time signal. After the adjustment of the second indication is effected in this way, the switch setting knob 7 is rotated in a right direction, whereby the lead means 4 moves back to a neutral position so that it is connected to the terminal G.

When rotating the switch setting knob 7 in the right direction shown in FIG. 4 for adjusting the second indication, the connection of the lead member 4 changes to terminal I for the time signal $1/n$ Hz in the same way as mentioned above. After the adjustment of the second indication, the switch setting knob 7 is rotated in the left direction, so that the lead means 4 also moves back to the neutral position.

As mentioned above, in the electronic watch according to the present invention, the second indication may be precisely adjusted while the watch remains in a continuously operative state by the time signal selected by changing the second adjustment switch for advancing or delaying the second hand, since the time signal for advancing or delaying the second hand is produced from the divider. Further, since the time signal is developed in various combinations of diffrent rates, the second indication may be adjusted to a great extent by only selecting one of a plurality of terminals for the respective time signals. Furthermore, the precise adjustment of the second indication can be effected by a simple operation requiring only a setting of the second adjustment switch.

What is claimed is:

1. In an electronic timepiece of the type comprising an oscillator circuit for developing an oscillatory output signal which defines a time base; a divider circuit connected to receive the oscillatory time base signal developed by said oscillator circuit for developing in response thereto an oscillatory time signal having a frequency determinative of the rate of advance of seconds which are indicated by the timepiece; a converter for converting the time signal into a seconds indication; and a driving circuit connected to receive the oscillatory time signal developed by said divider circuit for driving said converter with the oscillatory time signal; the improvement which comprises: a system for adjusting the seconds indication of the timepiece; said system comprising said divider circuit wherein said divider circuit includes means for developing a plurality of time signals including a first oscillatory time signal having a frequency for determining the standard once per second rate of advance of the seconds indicated by the timepiece, a second oscillatory time signal having a frequency higher than the frequency of the first oscillatory time signal for determining a rate of advance of the seconds indicated by the timepiece which is higher than the standard rate, and a third oscillatory time signal having a frequency lower than the frequency of the first oscillatory time signal for determining a rate of advance of the seconds indicated by the timepiece which is lower than the standard rate; and further comprising a time signal selection switch, connected between said divider circuit and said driving circuit, normally set to apply the first oscillatory time signal to said driving circuit for operating the timepiece in a mode with seconds indication advancing at the standard rate and operable for selectably applying the second or third time signals to said driving circuit for operating the timepiece in a mode with the seconds indication advancing at a rate respectively higher than or less than the standard rate to correct the seconds indication of the timepiece when it is respectively slow or fast without stopping operation of the timepiece.

2. In an electronic timepiece according to claim 6, wherein said selection switch comprises rotary means including a member mounted for rotation about an axis and having a peripheral groove extending parallel to the axis of rotation and a stopper for limiting rotation of the rotary means, and lead means defining a lead with one end thereof inserted into the peripheral groove of the rotary means and with another end thereof connected to said driving circuit.

3. In an electronic timepiece according to claim 2, further comprising a switch setting knob connected to said rotary means of said selection switch to permit manual rotation of said rotary means by rotation of said switch setting knob, and a stopper receiver for engaging said stopper to prevent excessive rotation of said rotary means which is limited in rotation by said stopper received in a stopper receiver.

4. In an electronic timepiece according to claim 2, further comprising a plurality of contacts connected to said divider circuit each for providing a different oscillatory time signal and disposed relative to said lead means for contacting the same as said lead means is displaced upon rotation of said rotary means, whereby said driver circuit is connected to receive selected ones of the oscillatory time signals.

5. In an electronic timepiece according to claim 4, wherein said lead means is normally connected to the one terminal of said plurality of contacts which provides the first time signal, and wherein the remaining ones of said contacts are positioned on opposite sides thereof so that rotating said setting knob in a right or left direction is effective to delay or advance the rate of seconds time indication by applying a corresponding one of the second or third oscillatory time signals to said driving circuit.

* * * * *